US005597612A

United States Patent [19]

Schoen et al.

[11] Patent Number: 5,597,612

[45] Date of Patent: Jan. 28, 1997

[54] PROCESS FOR THE MANUFACTURE OF PAPER WEBS HAVING CF OR CB LAYERS FOR PRESSURE-SENSITIVE RECORDING

[75] Inventors: Horst Schoen, Bielefeld; Horst W. Heyer, Schwalmtal; Wolfram Friesen, Nettetal-Lobberich, all of Germany

[73] Assignee: Stora Feldmuhle AG, Dusseldorf, Germany

[21] Appl. No.: 256,846

[22] PCT Filed: Jul. 26, 1993

[86] PCT No.: PCT/EP93/01982

§ 371 Date: Jul. 26, 1994

§ 102(e) Date: Jul. 26, 1994

[87] PCT Pub. No.: WO94/02258

PCT Pub. Date: Feb. 3, 1994

[30] Foreign Application Priority Data

| | | | |
|---|---|---|---|
| Jul. 27, 1992 | [DE] | Germany | 42 24 716.0 |
| Jul. 27, 1992 | [DE] | Germany | 42 24 718.7 |
| Jul. 27, 1992 | [DE] | Germany | 42 24 719.5 |

[51] Int. Cl.[6] ..... B41M 5/124

[52] U.S. Cl. ..... 427/152; 427/150; 427/151; 427/211; 427/358; 427/428

[58] Field of Search ..... 427/151–152, 427/428, 211, 358

[56] References Cited

U.S. PATENT DOCUMENTS

| | | | |
|---|---|---|---|
| 3,630,835 | 12/1971 | Busch | 162/184 |
| 3,705,049 | 12/1972 | Busch . | |
| 3,767,451 | 10/1973 | Busch | 427/150 |
| 3,897,578 | 7/1975 | Kanda et al. | 427/358 |
| 4,198,446 | 4/1980 | Goetz | 427/150 |
| 4,848,268 | 7/1989 | Sollinger et al. | 118/227 |
| 4,853,255 | 8/1989 | Onishi et al. | 427/152 |

FOREIGN PATENT DOCUMENTS

| | | |
|---|---|---|
| 160106 | 11/1985 | European Pat. Off. . |
| 153029 | 2/1987 | European Pat. Off. . |
| 385640 | 9/1990 | European Pat. Off. . |
| 454382 | 10/1991 | European Pat. Off. . |
| 1361996 | 7/1974 | United Kingdom . |
| 1524900 | 9/1978 | United Kingdom . |

OTHER PUBLICATIONS

Wochenblatt Für Papierfabrikation 23/24 (1987), pp. 1063–1068 (no mo.).

Dr.–Ing. M. Kustermann, "Speedsizer –The Technical Possibilities of This Universal Application System," pp. 2–7, Oct. 1988 (English language translation of Section 5–7 and Figure 17).

"Wochenblatt Für Papierfabrikation,"pp. 1067 1068, (English language translation of Section 4.2 and Figure 13). (no date).

*Primary Examiner*—Janyce Bell

*Attorney, Agent, or Firm*—Marshall, O'Toole, Gerstein, Murray & Borun

[57] ABSTRACT

A process is disclosed for manufacturing paper web containing a CF layer for pressure sensitive recording paper. In order to ensure full sizing, the paper web is subjected to intermass sizing and the coating ink containing color acceptors constituted of color-reactive, mineral pigments is applied with a coating device in which the paper web is guided between two transfer rollers separated by a gap or set at minimal pressure. One of the transfer rollers applies volumetrically pre-dosed coating ink by means of a rotary and driven surface-profiled doctor bar, forming the CF layer on one side of the paper web, and the other transfer roller at the same time applies a volumetrically pre-dosed aqueous solution on the other side of the paper web, also by means of a rotary driven surface-profiled doctor bar. The amount of color-reactive pigment in the dried CF-layer comprises between 3.5 and 5 g/m$^2$.

17 Claims, 2 Drawing Sheets

PROCESS FOR THE MANUFACTURE OF PAPER WEBS HAVING CF OR CB LAYERS FOR PRESSURE-SENSITIVE RECORDING

The invention is concerned with a process for the manufacture of paper webs having a CF layer for pressure-sensitive recording papers by application of a coating composition containing color-reactive mineral pigment or organic color acceptors.

The present invention is also concerned with a process for manufacturing a paper web having a CB layer for pressure-sensitive recording papers, by application of a coating composition, which contains a color precursor solution enclosed in microcapsules.

Finally, the invention is concerned with a process for manufacturing a paper web containing microcapsules in a layer with color precursor solution and color acceptors for it, by application of a coating composition which contains the microcapsules and color acceptors.

CF (coated front) layers in pressure-sensitive recording paper are defined as color receiving or color acceptor layers, which are usually placed on the top surface of a sheet of paper and produce an image by triggering a color reaction when they are brought into contact with color precursors or color formers.

CB (coated back) layers are layers on the back side of a sheet of paper, containing compounds called color formers or color precursors, which, in contact with color acceptors, form an image upon triggering a color reaction. In the invention, CB layers are defined as those containing a color precursor enclosed in microcapsules.

Color-reactive mineral pigments have found broad application as color acceptors; these are mostly called acid clay and acidic clay, among others, and belong to the group of the bentonite clays. In the present invention, color-reactive mineral pigments are understood to mean the above clays, especially those clays in which montmorillonite is the main mineral, but also other color-reactive clays, such as attapulgite.

In the present invention, organic color acceptors are generally understood to mean acidic oil-soluble organic substances, which lead to a color reaction with suitable color precursors based on basic chromogenic compounds. They include phenolic substances, such as phenol, resorcinol, naphthols and salicylic acid, which can also be alkyl-substituted, and can be present as monomers, oligomers or polymers (resins) and are metal-modified, preferably zinc-modified. For this purpose, phenoldi- or trioxybenzenes and 1- or 2-naphthol are known from DE 14 21 395 C3 as organic color acceptors. DE 12 75 550 B1 states polymers of phenolaldehyde and phenolacetylene as organic color acceptors, while in DE 22 28 431 B2 oil-soluble metal salts of phenolformaldehyde resin, for example, zinc(II) para-phenylphenolformaldehyde resinate are described. DE 16 71 642 B2 identifies phenolcarboxylic acid alkyl esters; according to DE 21 30 456 B2, phenolaldehyde resins with the addition of a vanadium salt or other metal salts are known. Another group of organic color acceptors is concerned with salicylic acid and its derivatives, among which a polymeric reaction product of an aromatic carboxylic acid with an aldehyde or acetylene, for example, a salicylic acid-aldehyde polymer is known from DE 21 52 763 A1. DE 21 47 585 B2 is concerned with salicylic acid or its derivatives with the addition of metal compounds.

The common technical problem of clays used as color-reactive pigments lies in the fact that they exhibit a rheological behavior during the manufacture and processing of the coating composition, which deviates from the behavior of other coating pigments in the paper industry, for example, kaolin or calcium carbonate. Sometimes abnormally high viscosities occur, which limits operations at high solid content. An economically significant problem is that color-reactive pigments are expensive and therefore must be used sparingly. One is forced to use low coating weights, but, at a coating weight below 6 to 6.5 g/m$^2$, when using the conventional coating method—equalization and metering the applied coating composition with a doctor blade and roller blade—sufficient coverage of the coating base paper is not achieved, so that the coating becomes nonuniform and uncoated areas remain. In order to achieve uniform coating structure and uniform coverage of the paper surface, even when low coating weights are applied, frequently, as remedy, the solid content and viscosity of the CF coating composition was reduced. As a result of this, although the coating composition spreads better after application on the substrate, it also penetrates more into the paper, so that less color-reactive pigment is available on the surface of the applied coating for color development, so that the intensity of the copy does not reach the desired strength. As a result of the higher water content of the coating composition, at a given drying capacity, the production rate will be limited. In order to achieve better coverage of the coating base paper, it has also been proposed to add, to the coating composition, pigments, which are not color reactive, for example, calcium carbonate or kaolin. However, in this case, in order to provide sufficiently high color intensity, one must apply not only the required amount of color-reactive pigment, but also the additional non-color-reactive pigment. The coating weight increases as a result and a more uniform coverage of the substrate surface to be coated can be achieved using common application equipment. However, a disadvantage is that, with increasing coating weight, the color transfer is worsened for CFB sheets thus prepared and used for multiple forms, so that the number of easily legible copies is reduced.

A method is proposed according to DE 26 23 802 B2 for producing CF layers in a paper machine. In this document, the problem of producing "receiving sheet layers" with acid-leached bentonite clays is discussed extensively, and, to eliminate the difficulties encountered, it is proposed to use a mixture of color-reactive pigment, calcium carbonate and, optionally, kaolin. The application was done with a coating blade or with the roll coaters that were known at that time. Generally, viscosities up to 7000 cps and solid contents up to 60 wt % are considered, for example, a viscosity of 5400 cps at a solid content of approximately 45 wt % is mentioned. The intended processability of the coating compositions of the art at speeds in the range of 460 m/min no longer corresponds to present-day requirements. Besides, it was found that coating compositions of the above viscosity range are difficult to control in practice so as to achieve a uniform coating structure and a constant. applied weight. For example, they cause lifting of the doctor blade or rod, and they result in a higher area weight and in nonuniform coating structure. The amounts of A inactive material to be added according to the known proposal preferably at least 25 wt % to a maximum of 45 wt. %, also involve a relatively low content of color-reactive pigment, specifically at applied weights in the range from approximately 4 to approximately 6 g/m$^2$.

EP 0 160 106 A1 also deals with the rheological problems (gel formation) of CF coating colors containing color-reactive pigment and provides for the combined addition of a bisphenol compound and calcium carbonate to a coating composition containing a special color-reactive pigment. Although the viscosities obtained are reduced considerably, there is still the disadvantage that a special color-reactive pigment is required and that the manufacture of the coating color is relatively complicated because of the large number of components involved. As coating device, application with a coating blade is proposed, but application of the coating color in an on-line process is not mentioned.

According to EP 0 153 029 B1, a process is known for two-sided coating of a paper web, and this process can also be used in the production of CFB sheets. A device is used for this purpose with which the CB coating composition is applied onto the surface of a roll and is metered with a doctor blade or doctor roll. The transfer of the applied CB coating composition onto the paper web is done by tangential introduction of the paper web onto the roll, and transfer is supported by a press roll arranged on the other side of the paper web. Another coating station serves to transfer a CF coating composition on the side of the paper web opposite to the CB layer; here, the coating color is applied, for example, with the aid of an applicator roll or is sprayed on (fountain applicator) and is equalized with a doctor blade or doctor roll. The known process serves mainly to avoid wrinkling of the web, but offers no further advantages compared to the already known state of the art with regard to improvement of the CF layer.

In addition to the disadvantages already described, the known coating devices have the following disadvantages in the application of color-reactive pigments: although they make it possible to apply uniform and well-covering coatings in the coating weight range below 6 g/m$^2$, air-knife-coating devices cannot be operated at the coating speeds which are customary today, because splashing of the coating composition occurs, or the coating composition will be unevenly distributed due to air turbulence. In order to be able to distribute coating compositions uniformly using an air knife, the coating compositions must be thinly flowing, which, disadvantageously, leads to severe penetration of the coating composition into the paper, so that less color-reactive pigment will be available for color reaction on the surface, and the intensity of the copy will be definitely worsened. Another problem is the severe penetration of the binder into the raw paper, as a result of which higher dosage of the binder becomes necessary. Another disadvantage arises from the high water content of the coating composition, and is the high energy requirement for the evaporation of the water. If the drying capacity of the coating machine is limited, sufficient drying of the applied coating color is possible only by reducing machine speed.

Doctor blade and roller blade devices have the common disadvantage that application becomes nonuniform due to paper roughness. If the coating weight is below 6 to 6.5 g/m$^2$, the coating composition will fill only the recesses in the paper, while the coating composition will be scraped away from the projecting parts (spatula effect). For CF-layers with this defect, the copy will not be continuous, but, rather, it will show multiple interruptions in the millimeter range. The only remedy is the admixture of non-color-reactive pigments, with the disadvantages already outlined above.

The disadvantages of roll-coating devices in the application of CF coating compositions are that, due to film splitting between paper and applicator roll, a nonuniform coating structure will form which is commonly called "orange-peel structure."

The application of organic color acceptors onto a paper web is also done from an aqueous coating composition, which contains, in addition to the organic color acceptors, one or more non-color-reactive mineral pigments, for example, calcium carbonate or kaolin, a binder, for example, a starch solution or a latex, as well as the usual additives, for example, dispersing agent, defoamer or additives to regulate the viscosity of the coating color. Mixtures of organic color acceptors with inorganic color acceptors—color-reactive mineral pigments, such as acid clay—have also been proposed. Solid contents between 25 and 60 wt % are known for coating compositions containing organic color acceptors. It is known that coating compositions containing organic color acceptors can be applied with an air-knife coating device, a bladecoating device and with the aid of a roller blade. The use of these coating devices involves the same disadvantages in the application of organic color acceptors as it was described above for the application of color-reactive mineral pigments.

When using blade or roll applicator devices for applying CF coating colors containing organic color acceptors, the same disadvantages arise as those already described in connection with application of CF coating colors containing color-reactive pigments.

If coating devices with roller blade equalization of the coating compositions are employed, the coating structure will not be sufficiently uniform in case of high speeds and low applied weights.

When applying CB coatings in which the color formers are enclosed in microcapsules as solutions in suitable oils or solvents, there are still certain problems in the production of a uniform coating structure, even at high machine speeds. The microcapsules, which, after destruction, for example, by the pressure of typewriter keys, liberate the solution of the color former for contact with the color acceptor, to allow the desired color reaction to occur, require especially careful and protective treatment. This applies to the manufacture, storage or further processing of the coating compositions which contain the microcapsules as well as to the paper sheets that have what is called CB layers.

As a protective measure against the destruction of the formed CB layers, stilt materials, for example, undissolved starch grains or fine cellulose fibers, are added to CB coating compositions. According to DE 21 43 636 A1, an air-knife coating device was proposed for the application of coating compositions containing microcapsules. This makes application of the coating composition possible, without exerting any pressure on the microcapsules. The disadvantages that arise here are the same as in the application of color-reactive mineral or organic color acceptors.

DE 19 06 823 B2 is concerned with a method of application for a capsule-containing liquid, where the paper web to be coated is guided between two rolls, one of which is the counter roll and the other the applicator roll. Small recesses are made in the surface of the applicator roll; these recesses are filled with the liquid containing the microcapsules and they are transferred from there onto the paper web. The applicator roll is immersed into a container that holds the microcapsule fluid and its surface is provided with a wiping device that is introduced between the container and the gap with the counter roll. The maximum solid content of the microcapsulefluid to be applied is given as 24 wt %. The disadvantage in this technique of application is the expensive manufacture of the applicator rolls and the dependence of the applied weight on the size of the recesses or their pattern on the applicator roll.

According to DE 21 43 635 B2, a method is described in which one side of the paper web is treated with an emulsion layer called microcapsule dispersion and the other side with a clay suspension. The application is done with the aid of a engraved roll, which is fed from a feed roll with coating composition, through an applicator roll onto a paper web.

A method is known from DE 29 03 972 A1 for the simultaneous coating of both sides of a paper web, where one side can be coated with a microcapsule layer and the other side with a color acceptor layer. A transfer roll is used for the application of the microcapsule coating and the surface of this transfer roll is predosed with the microcapsule dispersion using an engraved roll. The other side of the paper web can be provided with a color acceptor layer, also using an engraved roll or alternatively a doctor blade coating process.

According to DE 21 59 343 B2, a method is known for the coating of a material web with microcapsules, where a coating mass is applied in excess and then the excess is removed by pressing a solid device against it and the remaining coating mass is equalized on the material web. The pressing and equalization can be done with the aid of a doctor knife placed against a counter-pressure roll or with a metering doctor that presses either only against the material web or against a counter-pressure roll with the material web looped around this roll. The machine speeds given are a little more than 100 m/min. As a result of the pressure applied to the paper web, there is a danger of breaking the paper web, especially when the application is done with an applicator roll and the paper web is already wetted through.

Another disadvantage of air knives and doctorblade coating devices in the manufacture of CB layers lies in the separation of the insoluble starch grains or fine cellulose fibers used as stilt materials, from the coating composition.

The problems that arise in the application of CFor CB coating compositions also occur almost in the same way in the manufacture of self-contained papers (SC papers), when the manufacture of the recording layer is carried out using a coating composition which contains both microcapsules, as well as color acceptors.

Unless they are used as the last sheet in a set of forms, sheets that have a color acceptor layer (CF layer ) on their front side, are then provided with a CB layer on their back side, to produce a CFB sheet. Now, when during writing the pressure destroys the microcapsules and liberates the color-former solution, there is a danger that the color-former solution would spread also within the CFB sheet and would go through to the front side, that is, to the CF layer, as a result of which an undesirable color reaction would be triggered. In order to avoid this, the corresponding base papers already are fully internally sized, so that there will be a blocking action toward the color precursor solution spreading within the sheet of paper. However, at the same time, the paper loses its absorbent qualities so that the achievement of a uniform line structure at low applied amounts, approximately below 7 g/m$^2$, will become additionally difficult during the application of the CF coating composition, as well as of the CB coating composition.

In order to improve paper strength, frequently it is customary to provide the paper web intended for the application of the CF- or CB layer with a preparation that increases the strength of the paper. For the top sheets of a set of forms, the back side of which is provided with a CB layer, such a preparation serves to improve the printability on the front side. In the case of the last sheets of a set of forms, which are provided only with a CF layer on the front side, such a preparation serves to improve the printability of the back side. Mostly, such preparations, for example, starch solutions, are applied in the known manner with a sizing press in the paper machine itself. If the CF layer is also supposed to be applied with the aid of a coating device installed in the paper machine, in addition to the drying installation for the sizing press preparation, another drying installation is necessary for drying the CF layer. This results in another disadvantage from the point of view of economy, as well as with regard to the space required for the necessary equipment.

Based on the problems outlined above, an objective of the present invention is to make available a process which fulfills the following requirements:

Production of a uniform coating structure, even at high machine speeds, with the prerequisite that a coating base paper, which is fully internally sized, is used both in the application of CF coating composition based on color-reactive mineral pigments, or based on organic color acceptors, as well as during the application of a usual CB coating composition containing the usual microcapsules and stilt materials.

Regarding a CF coating composition, containing a color-reactive mineral pigment, particular objectives of the invention are as follows:

To obtain a uniform coverage of the paper surface with a small amount of coating applied, even without addition of inactive pigments to the coating color, with simultaneous fulfillment of the requirement that a sufficiently large amount of color-reactive pigment is present in the CF layer, even when the amounts applied are low;

applicability of the method in a paper machine, as well;

the possibility of application of a CF coating composition with simultaneous application of a solution or composition on the side of the paper web opposite to the CF layer and simultaneous drying of the CF coating composition and solution or composition in a common drying apparatus.

Regarding the application of CF coating compositions with organic color acceptors, the particular objectives of invention are as follows, to make good coverage of the paper surface possible, even with the prerequisite that only a small coating weight is applied;

to reduce the penetration of the still wet CF coating composition into the paper web;

to make it possible to apply the CF coating composition on one side of the paper web and an aqueous solution or composition on the other side of the paper web simultaneously, whereby the drying of the CF coating compositions and aqueous solution or composition should occur in a common drying apparatus;

to make it possible to apply the process even in a paper machine.

With regard to the application of CB coating compositions, the particular objectives of the invention are as follows:

to make it possible to process CB coating compositions in a wide range of solid content and viscosity;

to avoid separation of the stilt material;

to make it possible to use the process in a paper machine;

to make it possible to apply the CB coating composition with simultaneous application of a solution or composition on the side of the paper web opposite to the CB layer and to be able to dry the CB coating composition and the solution or composition simultaneously in a common drying device.

Finally, another objective of the invention is the development of a process with which a coating composition containing both microcapsules, as well as color acceptors, can be applied to form an SC layer (self-contained layer) on one side of a paper web.

In order to meet the present objectives, the invention uses the devices described under the designation "speedsizer" that became known in the DE citation: Wochenblatt für Papierfabrikation 23/24 (1987), pp. 1063 ff. and in DE 34 17 487 A1. In these documents, the use of known devices as sizing press and for the application of coating compositions is disclosed, but the manufacture of CF and CB sheets is not mentioned.

Especially, the special rheological problems that occur during the application of CF coating compositions that contain mineral color-reactive pigments as color acceptors, is not mentioned.

The invention provides, in a process for the manufacture of a paper web having a CF layer for pressure-sensitive recording papers, by application of a coating composition, in which the color acceptors consist of color-reactive mineral pigments, the combination with the following characteristics:

the paper web is internally sized to achieve full sizing;

the application of the coating composition is done with a coating device, in which the paper web is guided between two transfer rolls separated by a gap or adjusted to minimum pressing pressure;

one of these transfers the volumetrically predosed coating composition with the aid of a rotatably driven surface-profiled doctor bar, to form the CF layer on one side of the paper web;

and the other transfers simultaneously, onto the other side of the paper web, a volumetrically predosed aqueous solution or composition in this case, too, with a rotatably driven surface-profiled doctor bar;

the amount of the color-reactive pigment in the dry CF layer is 3.5 to 5 g/m$^2$.

In a method for the preparation of a paper web having a CF layer for pressure-sensitive recording papers, by application of a coating composition containing an organic color acceptor, the invention provides the combination of the following characteristics:

in order to achieve full sizing, the paper web is internally sized;

the application of the coating composition is done with a coating device in which the paper web is guided between two transfer rolls, separated by a gap or adjusted to minimum pressing pressure;

one of these transfers with the aid of a rotatably driven surface-profiled doctor bar, a volumetrically predosed coating composition, to form the CF layer on one side of the paper web;

and the other transfers simultaneously onto the other side of the paper web an aqueous solution or composition which is volumetrically predosed with the aid of a rotatably driven surface-profiled doctor bar;

the amount of organic color acceptors in the dry CF layer is 0.2 to 2.0 g/m$^2$.

In a process for the manufacture of a paper web that has a CB layer for pressure-sensitive recording papers, using a CB coating composition which contains a color precursor solution enclosed in microcapsules, the invention provides the combination of the following characteristics:

the paper web is internally sized to achieve full sizing;

the application of the coating composition is done with a coating device in which the paper web is guided between two transfer rolls separated by a gap;

one of these transfers volumetrically predosed coating composition with the aid of a rotatably driven surface-profiled doctor bar to form the CF layer on one side of the paper web;

and the other transfers an aqueous solution or composition volumetrically predosed also with the aid of a rotatably driven surface-profiled doctor, simultaneously, onto the other side of the paper web.

In a method for the production of a paper web, which contains microcapsules in a layer with enclosed color precursor solution, and color acceptors for it, by application of a coating composition, which contains the microcapsules and the color acceptors, the invention provides a combination of the following characteristics:

the paper web is internally sized to achieve full sizing;

the application of the coating composition is done with a coating device in which the paper web is guided between two transfer rolls separated by a gap;

one of these rolls transfers, with the aid of a rotatable driven surface-profiled doctor bar, a volumetrically predosed coating composition to form the SC layer on one side of the paper web;

and the other roll transfers, also with the aid of a rotatably driven surface-profiled doctor, a volumetrically predosed aqueous solution or composition simultaneously on the other side of the paper web.

The expression "simultaneously" used in the claims and in the description in connection with the application of a coating composition on one side and an aqueous solution or composition on the other side of the paper web, is to be understood as being within the framework of the present invention, so that the transfer of the predosed coating color or solution onto the paper web is done by a cooperating pair of transfer rolls. If the paper web is guided vertically into the gap between the transfer rolls, the transfer of the coating composition or solution, predosed on the cylindrical surface of the transfer rolls is simultaneous; however, if the paper web is not guided vertically but so that the paper web lies against a part of the periphery of one of the two transfer rolls, so that the coating composition or solution to be transferred with the aid of this roll is transferred first, while the second coating composition or solution is applied when the web enters the gap between the pair of rolls, then, although the transfer does not occur absolutely simultaneously, it occurs with such a minimum time period between the two applications that this is of no importance for the purposes of the invention. A minimum time shift caused by changing the guidance of the paper web during application is therefore encompassed within the scope of the invention.

In the method given above for the application of CF coating compositions, the pressing pressure between the two applicator rolls is preferably adjusted to a value between 10 and 40 kN/m.

According to another preferred embodiment, the gap between the two applicator rolls is smaller than the thickness of the uncoated paper. Expediently, the gap is adjusted when applying higher coating weights, while at low applied weights, the pressing pressure is to be adjusted in the range given above. When applying a coating composition that contains microcapsules, the adjustment of the gap is preferably again such that the adjusted gap is smaller than the thickness of the uncoated paper.

For the application of CF coating compositions based on mineral color-reactive pigments and based on organic color acceptors, according to the invention, the solid content of the CF coating color is adjusted to >40 wt. %, preferably, the solid content is >42 wt % and especially preferably >45 wt. %. The viscosities of the CF coating compositions with color-reactive mineral pigments to be used can lie between 500 and 5000 mPa.s, preferably not more than 2000 mPa.s, while the viscosities of the coating compositions with organic color acceptors to be used can be in the range between 200 and 2000 mPa.s.

The expression "full sizing" used in the claims and description in connection with the invention, is defined as a degree of sizing in the range from 18 to 35° Cobb.

The terms CB coating composition and CB layer used herein is to be understood to mean aqueous coating compositions which, in addition to microcapsules, also contain a binder for these, for example, based on latex or starch. The term starch also includes starch derivatives, such as starch esters. Furthermore, the coating compositions that contain microcapsules also contain what is called stilt materials, based on non-dissolving small starch grains, or based on fine- and short cellulose fibers.

The diameter of the spacer lies at 20 to 60 μm. The solid content of the CB coating composition preferably lies in a range between 15 and 45 wt. %.

The aqueous solution or composition which is to be applied on the front side of the CB sheet or on the back side of the CF sheet according to the invention can consist of water, but with this, only the curl behaviour of the paper web is limited or prevented. However, preferably, a starch solution is used as aqueous solution, so that also the printability is improved as a result of better binding of the paper fibers.

Within the framework of the invention, this also includes starch derivatives, for example, starch ethers or starch esters. Furthermore, solutions of polyvinyl alcohol and CMC are also suitable.

Experiments that have been performed showed that, even at relatively low applied weights, in the range from 4 to 5 g/m$^2$ in the CF layers, in which the color acceptors consist of color-reactive mineral pigments, one could achieve a constant applied weight and good coverage of the coating base-paper surface with uniform application of the coating, which is attributed among others to the volumetric predosing with the aid of the surface-profiled doctor bar. So far, that is, during the dosage of the coating composition with the aid of a doctor blade or doctor roll lying against the paper web, only poor coverage could be achieved at applied weights in the range given above. The uniformity of application permits omission of admixture of inactive pigments, for example, calcium carbonate, which was so far considered necessary for adjusting sufficient uniformity of the coating, so that, in the method according to the invention, at the same time, the coating weight can be reduced down to 4 g/m$^2$. In spite of these low surface weight ranges, there is a sufficient amount of color-reactive mineral pigment available for the color reaction with colorless color precursors. Preferably, the CF coating compositions contain only color-reactive mineral pigment and no other non-color-reactive pigments. Thus, although the admixture of non-color-reactive pigments is no longer absolutely necessary for improving the uniformity of the coating, as before, they can be present in the CF coating composition or CF layer. Even when the amount of the color-reactive pigment is not more than 50 wt. %—based on the total pigment content—and with a low applied amount of coating, the process according to the invention leads to satisfactory results, but the amount of non-color-reactive pigment is preferably not more than 30 wt %, based on the total pigment content. In order to stabilize the high pH values, calcium carbonate can be added to the CF coating compositions. With kaolin or talc, by closing the surface, the rate of uptake of the printing ink can be slowed down in case a sheet coated with a CF layer has to be printed additionally. Talc will also be used to make the surface hydrophobic and to smooth it, as a result of which the transfer of the color precursor solutions in the set of forms is improved. Barium sulfate and aluminum hydroxide produce higher basic whiteness and optical brightening of the CF layers; chlorite can be used in exchange for talc, but this leads to better intensity of the copy. Inhibited starches, that is, starches, the solubility of which is limited or which are insoluble, leads to a reduction of the coating opacity, so that the brightening of the base paper shines through more strongly.

According to the invention, the maximum amount of coating applied is 9 g/m$^2$, but preferably the amount applied is not less than 4 g/m$^2$ and not more than 7 g/m$^2$. The uniform coating structure that can be achieved according to the process of the invention is surprisingly also caused by the lower applied coating weight, since, at low applied coating weights, the orange peel effect caused by film splitting is reduced. This effect is reduced even more when the amount of starch or starch derivatives is adjusted to not more than 20 wt %, based on the total binder, in CF coating compositions with color-reactive mineral pigments.

As can be shown by a comparison of a CF sheet prepared according to the invention and a CF sheet prepared with the same coating composition, in which the equalization and dosage of the coating composition was done with a roller blade, shows that the actual advantage of the invention lies in the fact that one can obtain a uniform coating structure and thus good coverage of the coating base-paper surface, even at low applied coating weights, while maintaining a uniform application weight. At the same or lower applied weight, as a result of the improved coverage of the coating base-paper surface, the invention makes it possible to obtain higher quality of the image produced by the color reaction between the color precursor and color-reactive mineral pigment.

The comparison of a standard CF sheet with a CF sheet produced according to the process of the present invention, described below, shows that the coating base-paper surface is covered significantly better in the CF sheets produced according to the invention. Both sheets were produced under production conditions with the same coating composition, in which the color acceptors consist of color-reactive mineral pigment, using the same coating base-paper. The production of the standard CF sheet was done on a coating machine equipped with the usual roller blade. The applied weight was 7 g/m$^2$ in the case of the standard sheet; 6.5 g/m$^2$ were applied according to the invention.

In order to prove the different coating quality or coverage of the coating base-paper surface, the surfaces of the two sheets produced were colored with a color precursor solution that produces a blue color, so that a deep-blue color resulted on the sheets. The more uniform coloration of the CF sheet according to the invention can be detected even with the naked eye. Of the two produced sheets, copies were made on transparent films at an illumination intensity adjusted to the highest brightness stage and the copies produced were investigated on the formation tester of the Kajaani Company. Two copies of each of the two samples were used for the investigation, whereby 2 measurements of the flock size were carried out on each copy. In the present connection, the flock size is defined as the black-colored areas of the copies. Table 1 below shows the amount of black-colored flocks that were >100 mm$^2$, in percent of the total surface, for 4 performed measurements.

TABLE 1

| Standard | According to the Invention |
|---|---|
| 28.41 | 4.14 |
| 37.25 | 5.53 |
| 37.65 | 16.11 |
| 39.47 | 4.04 |

The results obtained confirm the difference of the two samples that could already be detected with the naked eye.

The coating base-papers to be used within the framework of the present invention show the weight per unit area in the range from 35 to 50 g/m$^2$, preferably from 36 to 46 g/m$^2$.

As it was shown by coating experiments with CF coating compositions containing organic color receptors, a more uniform applied coating, a constant amount of applied weight and good coverage of the coating base-paper surface is achieved, even at relatively low applied weights, which is attributed to the volumetric predosage with the aid of a surfaceprofiled doctor bar. The procedure that is known in the art, namely, to mix mineral non-color-reactive pigments, for example, calcium carbonate or kaolin, to the CF coating colors containing organic color acceptors, is retained in the process according to the invention. Here, the mineral pigments act as carriers for the organic color acceptors, and improve their effectiveness. The amount of mineral non-color-reactive pigments can be up to 90 wt %, based on the total solid content of the coating color. Preferably, in addition to calcium carbonate, kaolin, barium sulfate, talc, chlorite, precipitated silicate, aluminum hydroxide, inhibited starch or a mixture of these substances is used.

The actual advantage of the invention, in the case of application of CF coating compositions with organic color acceptors, lies in the fact that one can apply a sufficient amount of organic color acceptors within the CF layer and one can obtain a satisfactorily covered paper surface with very low applied weights, preferably in the range of 3 to 6 g/m$^2$. As a result of this, the image produced by reaction between the color precursor and the color acceptor will have sufficient intensity. Preferably, the amount of the applied organic color acceptor is in the range between 0.4 and 1 g/m$^2$.

As already mentioned, according to the invention, simultaneously with a CB coating composition to be applied on the back side, one can treat the front side of a CB sheet with an aqueous solution, for example, with a starch solution. In order to further improve the printability of the side of the paper web opposite to the side with the CB layer, it was found to be especially advantageous to smoothen at least this side before the coating process. For this purpose, within the framework of the present invention, any known devices can be used with which one or both sides of the paper web can be smoothened. This includes both the devices that operate with several metal rolls that are in contact with one another, or with installations in which the metal rolls are in contact with the more or less elastic rolls. Smoothing of the side that is opposite to the CB layer is especially expedient when a CF layer is to be applied to this side, too. Although the produced smoothing is adversely influenced by the subsequent coating process with the CF coating composition or, for example, with an aqueous starch solution, yet the smoothness of the base-paper web to be coated can be adjusted so that, even after the application of the CB layer and CF layer or of a starch solution, there will be sufficient smoothness to produce an image of satisfactory intensity. Advantageously, the smoothness before the coating process is adjusted to a value of at least 80 Bekk sec.

Therefore, within the framework of the present invention, the simultaneous application of a CB coating composition on one side of the paper web and a CF coating composition on the other side Of the paper web is of special economical significance. In case of simultaneous application of a CB coating composition on the other side of the paper web, one can use as CF coating composition both coating compositions with color-reactive mineral pigments or those with oilsoluble organic substances with an acidic reaction. Preferably, the solid content of these CF coating compositions is >40 wt %. The solid content of the CB coating compositions to be used according to the invention preferably lies in the range from 15 to 45 wt %.

If the coating device to be used according to the invention is installed into a paper machine instead of a sizing press, which was previously customary, the advantage arises which is especially favorable from the economical point of view, that both the CF coating composition applied on the front side as well as the starch solution or CB coating composition applied on the back side can be dried in a single drying device. Therefore, carrying out the process in the paper machine (on line) is especially preferred.

The surface profiling of the doctor bars represents recesses, for example, in the form of ridges, but they can also be designed as a thread, whereby the doctor bar is profiled preferably by milling as such, or a wire can be wound around the bars to produce the profile. The depth of the profile and the pressing pressure applied between the doctor bar and the transfer roll regulate the amount of CF coating composition applied. The direction of rotation of the doctor bar is opposite to the direction of movement of the paper web.

Table 2 below shows various CF coating compositions in which the color acceptors consist of color-reactive mineral pigment and gives the results that were obtained in pilot experiments with a coating device installed in a paper machine.

Besides the essential components, pigment and latex or starch ester as binder, the coating colors also contained the usual additives in an amount not exceeding 3 parts by weight, such as carboxymethylcellulose, to regulate the viscosity, sodium hydroxide to adjust the pH value to approximately 10.3, as well as calcium stearate. The coating colors were adjusted to the solid content given in Table 1 by the addition of water.

TABLE 2

| | 1 | 2 | 3 | 4 | 5 | 6 | 7 | 8 | 9 | 10 |
|---|---|---|---|---|---|---|---|---|---|---|
| acidic clay | 70 | 95 | 100 | 100 | 95 | 80 | 70 | 90 | 60 | 50 |
| calcium carbonate | 30 | 5 | — | — | 5 | | | | 40 | 25 |
| kaolin | | | | | | 20 | — | — | | |
| $Al(OH)_3$ | | | | | | — | 30 | — | | 25 |
| inhibited starch | | | | | | — | — | 10 | | |
| latex | 19 | 19 | 19 | 19 | 17.5 | 19 | 19 | 19 | 16 | 16 |
| starch ester | | | | | 3 | | | | 3 | 3 |
| solid content of the coating composition, weight % | 48 | 47 | 46 | 47 | 45.5 | 46 | 50 | 48 | 52 | 53 |
| applied weight, g/m$^2$, of the CF layer | 6.8 | 6.0 | 5.7 | 4.5 | 5.2 | 6.1 | 6.8 | 5.2 | 8.9 | 8.8 |
| color-reactive pigment, g/m$^2$, in the CF layer | 4.0 | 4.8 | 4.8 | 3.6 | 4.3 | 4.1 | 4.0 | 3.9 | 4.4 | 3.6 |
| viscosity, mPas | 850 | 850 | 900 | 1400 | 1200 | 500 | 1800 | 1500 | 780 | 780 |

The data regarding the amounts of the individual components of the coating color refer to dry parts by weight. The coating structure was uniform in all experiments, with good coverage of the paper surface.

Table 3 shows various CF coating colors with organic color acceptors, which were also applied in an experimental coating device installed in a paper machine.

TABLE 3

| | 1 | 2 | 3 | 4 | 5 | 6 |
|---|---|---|---|---|---|---|
| calcium carbonate | 73 | 60 | 72 | 60 | 60 | 60 |
| Na—Al silicate | | 20 | | 20 | 20 | 20 |
| Zn-modified alkyl-substituted phenolaldehyde condensation product | 13 | 20 | | 20 | 20 | 20 |
| Zn-modified salicylic acid derivative | | | 13 | | | |
| starch ester | 13 | 16 | 13 | 6 | 6 | 6 |
| polyvinyl alcohol | | | | 6 | 5 | 5 |
| additive | 1 | — | — | — | — | — |
| solid content of the coating composition, weight % | 40.2 | 41.5 | 44 | 45.5 | 47.5 | 49.6 |
| viscosity, mPa · s | 450 | 1660 | 300 | 1900 | 255 | 930 |
| applied weight, g/m$^2$, of the CF layer | 3.4 | 3.8 | 4.3 | 5.0 | 5.6 | 5.8 |
| organic color acceptor, g/m$^2$, in the CF layer | 0.4 | 0.6 | 0.6 | 0.9 | 1.0 | 1.0 |

The data regarding the amounts of the individual components of the coating color refer to dry parts by weight. Balance: water. The coating structure was uniform in all experiments.

The application of the coating composition given in Tables 2 and 3 was done onto a neutral-sized, wood-free base-paper having a basis weight of 39 g/m$^2$ at a rate of 600 m/min. A 12% starch solution was applied on the back side, so that the resulting applied weight was 0.9 g/m$^2$, calculated as dry parts by weight.

The viscosity values given in Tables 2 and 3 were determined with a Brookfield viscometer at 100 rpm and with spindle 3.

A coating composition containing microcapsules and a color-reactive mineral pigment for the production of an SC paper is produced as follows:

| | |
|---|---|
| acidic clay | 80 |
| kaolin | 20 |
| latex | 26 |
| microcapsules | 71 |
| stilt material | 28 |
| solid content of the coating composition, wt. % | 35 |
| applied weight, g/m$^2$ | 11 |

The application was done onto the coating basepaper described in Tables 2 and 3 and the same process conditions were employed. If one writes on a normal writing paper that was placed on the produced SC sheet, an easily legible copy is produced on the SC sheet. Both the front side, as well as the back side of the produced SC sheet shows that the paper surface is well-covered, and the coating structure is uniform and the paper surface has outstanding printability.

BRIEF DESCRIPTION OF THE DRAWINGS

FIG. 1 is a schematic representation of a side view of a coating device as it is known under the name "speedsizer" from Wochenblatt der Papierfabrikation 23/24 (1987), pages 1063 ff.

FIG. 2 is a photocopy of the standard CF sheet described for Table 1.

FIG. 3 is a photocopy of the CF sheet according to the invention, described in connection with Table 1.

Figure 1:
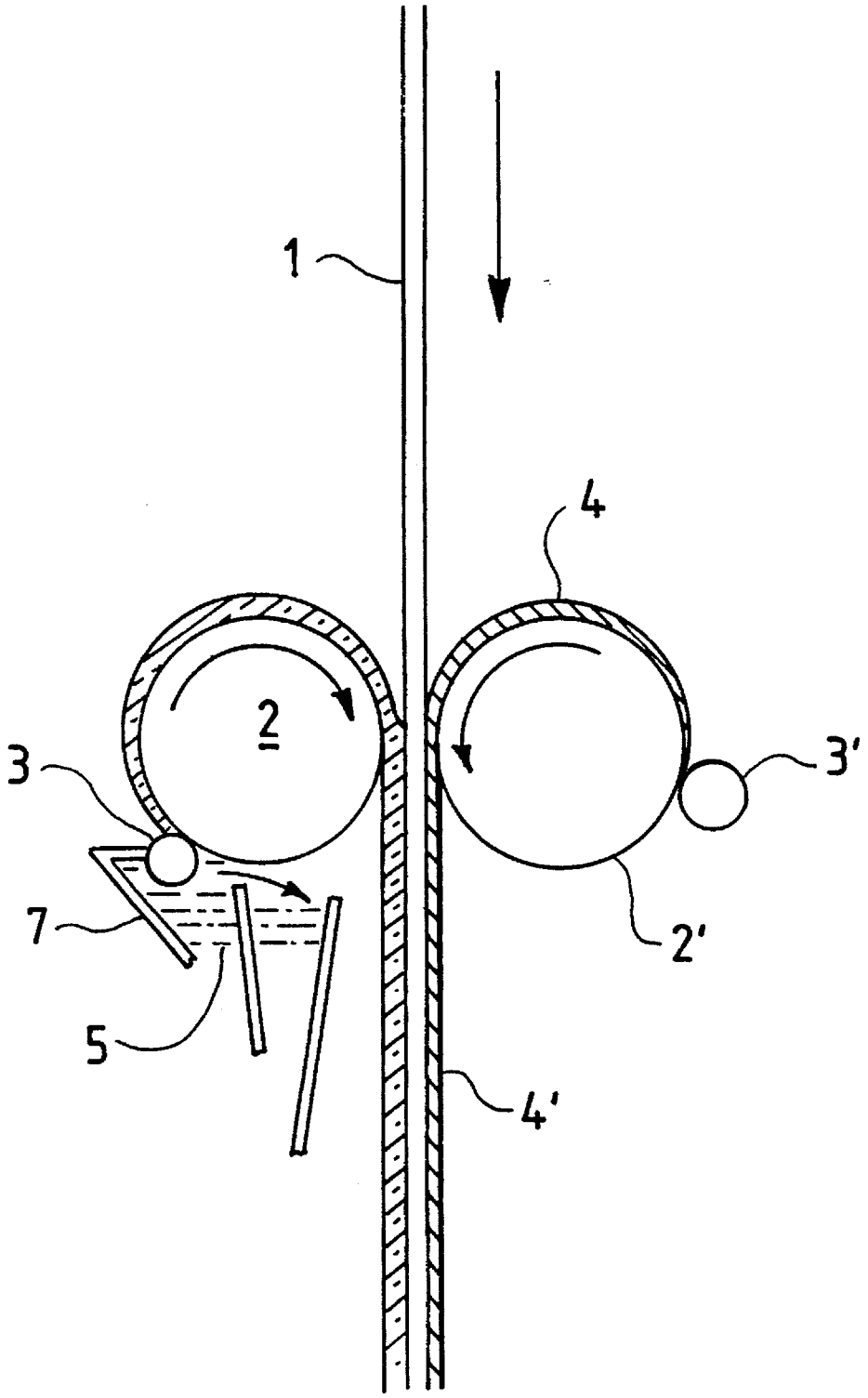
FIGS. 1 to 3 show the following.
Figure 2:
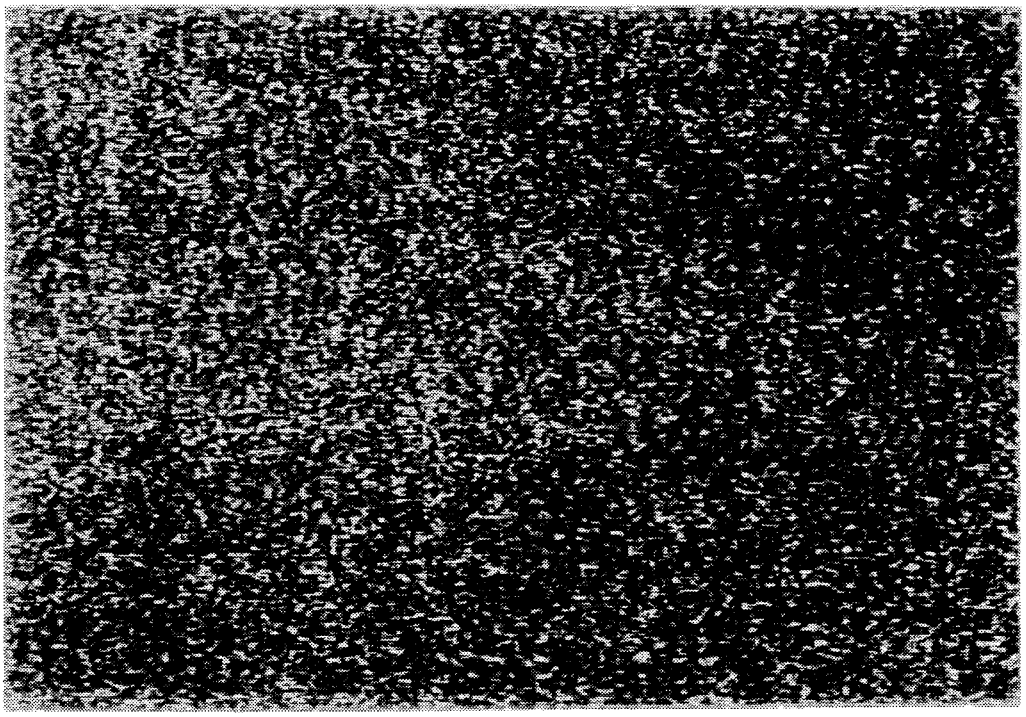
Figure 3:
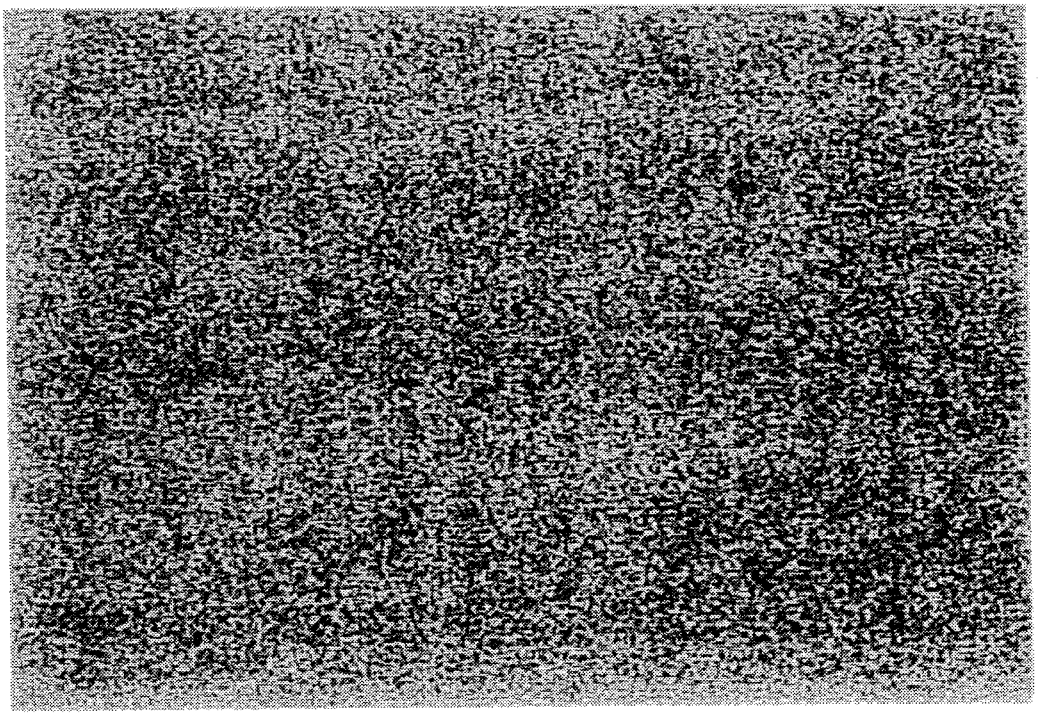

The following describes the process according to the invention, with the aid of FIG. 1:

A predosed layer of aqueous starch solution (5) is on the surface of a first transfer roll (2), while a coating composition (4) for the formation of a CF layer (4') is predosed onto the surface of the other transfer roll (2'). The predosage is carried out in the case of the starch solution using a ridged doctor (3) shown in a simplified form and in the case of the CF coating color (4), with the aid of the ridged (i.e., surface-profiled) doctor (3'). Both doctors are driven opposite to the direction of rotation of the transfer rolls. From the surfaces of the transfer rolls, the predosed starch solution (5) and the CF coating composition (4) are transferred onto the paper web (1). In the left part of the Figure, a device is shown in a simplified form, which includes a doctor holder (7) that is also shown schematically. The starch solution (5) is applied in excess to the surface of the transfer roll (2). As indicated by the arrow, the excess starch solution runs down. In the right side of the Figure, the same doctor holder or color vat can be installed. Doctor holder, color vat and color guide devices are not the objects of the present invention and therefore can also be replaced by other suitable devices, for example, by color applicator tubes.

In the case of CF coating compositions, the color acceptors can consist either of mineral color-active pigments or they can be organic color acceptors.

When adjusting the gap of the transfer rolls, a CB coating composition can be applied, while the other side is treated with a starch solution or a CF coating composition.

We claim:

1. Method for the manufacture of a paper web having a CF layer for pressure-sensitive recording papers, by application of an aqueous coating composition containing reactive color acceptors consisting essentially of color-reactive mineral pigment, characterized by the combination of the following characteristics:

the paper web is internally sized;

the application of the coating composition is done with a coating device, in which the paper web is guided between two transfer rolls separated by a gap or set to a pressing pressure;

wherein one of said rolls transfers volumetrically predosed coating composition for forming the CF layer on one side of the paper web with the aid of a rotatable and driven surface-profiled doctor bar;

the other of said rolls transfers simultaneously a volumetrically predosed aqueous solution or composition onto the other side of the paper web with the aid of a rotatable and driven surface profiled doctor bar; the amount of the color-reactive pigment in the CF layer is 3.5 to 5 g/m$^2$ calculated on a dry basisi the solid content of the CF coating composition is >40 wt %;

the viscosity of the CF coating composition is in the ranqe of 500 to 2000 mPa.s; and, the CF coating composition is applied in an amount of 4 to 9 g/m$^2$ (calculated as dry parts by weight).

2. Method according to claim 1 characterized by the fact that, besides the color-reactive mineral pigment, the CF coating composition also contains up to 50 wt %—based on the total pigment content, calculated as dry parts by weight—of a non-color-reactive pigment selected from the group consisting of calcium carbonate, kaolin, barium sulfate, talc, chlorite, precipitated silicate, aluminum hydroxide and inhibited starch or a mixture thereof.

3. Method according to claim 1, characterized by the fact that, besides the color-reactive mineral pigment, the CF coating composition contains up to 30 wt %—based on the total pigment content, calculated as dry parts by weight—of a non-color-reactive pigment selected from the group consisting of calcium carbonate, kaolin, barium sulfate, talc, chlorite, precipitated silicate, aluminum hydroxide and inhibited starch or a mixture thereof.

4. Method according to claim 1, characterized by the fact that the CF coating composition is applied in an amount of 4 to 7 g/m$^2$ (calculated as dry parts by weight).

5. Method for the manufacture of a paper web for pressure-sensitive recording papers having a CF layer by application of an aqueous coating composition containing reactive color acceptors consisting essentially of organic color acceptors, characterized by the following characteristics:

the paper web is internally sized;

the application of the coating composition is done with a coating device in which the paper web is guided between two transfer rolls separated by a gap or set to a pressing pressure;

wherein one of said rolls transfers volumetrically predosed coating composition for the formation of the CF layer on one side of the paper web with the aid of rotatable and driven surface-profiled doctor bar;

the other of said rolls transfers simultaneously onto the other side of the paper web a volumetrically predosed aqueous solution or composition with the aid of rotatable and driven surface-profiled doctor bar;

the amount of organic color acceptors in the CF layer is 0.2 to 2.0 g/m$^2$ calculated on a dry basis;

the solid content of the CF coating composition is >40 wt. %;

the viscosity of the CF coating composition is in the range of 200 to 2000 mPa.s; and, the CF coating composition is applied in the amount of 3 to 6 g/m$^2$ (calculated as dry parts by weight).

6. Method according to claim 2, characterized by the fact that, besides the organic color acceptors, the CF coating composition contains up to 90 wt %—based on the total solid content—of a non-color-reactive pigment selected from the group consisting of calcium carbonate, kaolin, barium sulfate, talc, chlorite, precipitated silicate, aluminum hydroxide, inhibited starch or a mixture thereof.

7. Method for the manufacture of a paper web having a CB layer for pressure-sensitive recording papers by application of an aqueous CB coating composition containing a color precursor solution enclosed in microcapsules, characterized by the combination of the following characteristics:

the paper web is internally sized;

the application of the coating composition is done with a coating device in which the paper web is guided between two transfer rolls separated by a gap;

in order to form the CB layer, one of said rolls transfers onto one side of the paper web the volumetrically predosed coating composition with the aid of rotatable and driven surface-profiled doctor bar; and the other of said rolls transfers simultaneously onto the other side of the paper web a volumetrically predosed aqueous solution or composition with the aid of rotatable and driven surface-profiled doctor bar.

8. Method according to claim 7, characterized by the fact that the solid content of the CB coating composition is 15 to 45 wt %.

9. Method according to claim 7, characterized by the fact that the aqueous solution or composition is a CF coating composition.

10. Method according to claim 9, characterized by the fact that the CF coating composition contains, as color acceptors, color-reactive mineral pigments or oil-soluble organic substances with an acidic reaction as color acceptors.

11. Method according to claim 9, characterized by the fact that the solid content of the CF coating composition is >40 wt %.

12. Method according to claim 7, characterized by the fact that, before the application of the CB coating composition, the paper web is smoothened on at least one side, which is opposite to the side intended for the application of the CB coating composition.

13. Method according to one of claims 1 or 5, characterized by the fact that a pressing pressure between 10 and 40 kN/m is set between the two applicator rolls.

14. Method for the manufacture of a paper web which contains, in a layer, microcapsules with color precursor solution enclosed in them and color acceptors thereof, by application of an aqueous coating composition in which the microcapsules and the color acceptors are contained, characterized by the combination of the following characteristics:

the paper web is internally sized;

the application of the coating composition is done with a coating device in which the paper web is guided between two transfer rolls separated by a gap;

one of said rolls transfers onto one side of the paper web a volumetrically predosed coating composition to form an SC layer with the aid of rotatable and driven surface-profiled doctor bar; and the other of said rolls simultaneously transfers onto the other side of the paper web a volumetrically predosed aqueous solution or composition with the aid of rotatable and driven surface-profiled doctor bar.

15. Method according to one of claims 1 to 14, characterized by the fact that the gap between the two applicator rolls is smaller than the thickness of the uncoated paper.

16. Method according to one of claims 1, 5, 7 or 14, characterized by the fact that the aqueous solution is a starch solution or a solution of polyvinyl alcohol or of CMC.

17. Method according to one of claims 1, 5, 7 or 14, characterized by the fact that it is carried out in a paper machine.

* * * * *